US007570897B2

(12) United States Patent
Nihei

(10) Patent No.: US 7,570,897 B2
(45) Date of Patent: Aug. 4, 2009

(54) DUPLEX IMAGE FORMING APPARATUS AND METHOD WITH CONTROL FOR EJECTING DIFFERENT SIZE RECORDING SHEET

(75) Inventor: Hironobu Nihei, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 11/385,649

(22) Filed: Mar. 22, 2006

(65) Prior Publication Data

US 2006/0228126 A1 Oct. 12, 2006

(30) Foreign Application Priority Data

Apr. 8, 2005 (JP) ..... 2005-112469

(51) Int. Cl.
*G03G 15/00* (2006.01)

(52) U.S. Cl. ..... 399/82; 399/389; 399/401

(58) Field of Classification Search ..... 399/82, 399/389, 401

See application file for complete search history.

(56) References Cited

U.S. PATENT DOCUMENTS

2003/0215254 A1* 11/2003 Otomo ..... 399/55

FOREIGN PATENT DOCUMENTS

JP 10-31394 2/1998

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

The length of recording paper being conveyed to an image forming section is detected. If it is found that the length is shorter as a result of the detection, the recording paper is conveyed to a reversing section to be refed to the image forming section to continue conveyance of the recording paper as in the normal image formation, but without performing the image formation. As a result, the sequence of the recording paper ejected to the paper output section is the same as that of normal printing. Thus a user can easily decide the paper on which the image formation is not carried out normally.

5 Claims, 8 Drawing Sheets

DUPLEX IMAGE FORMING APPARATUS AND METHOD WITH CONTROL FOR EJECTING DIFFERENT SIZE RECORDING SHEET

BACKGROUND OF THE INVENTION

1. Field of the Invention

The present invention relates to an image forming apparatus such as a copying machine and laser printer and an image forming method.

2. Description of the Related Art

An image forming apparatus such as a copying machine and laser printer generally feeds and conveys recording paper from a paper feeder to an image forming section, carries out image formation by a transfer method (indirect method) or direct method, and ejects the recording paper passing through the image formation to the paper output section. Among such image forming apparatuses, there are those which automatically perform image formation on both sides of the recording paper in response to a duplex printing instruction of the recording paper, and output the recording paper passing through the image formation.

Such an image forming apparatus that carries out the image formation on both sides of the recording paper is disclosed in Japanese patent application Laid-open No. 10-31394 (1998), for example. According to it, if the size of the paper being conveyed through the machine does not agree with the user-designated paper size, and hence the image formation is not carried out normally on the recording paper, the recording paper is ejected to the paper output section without reversing the paper at a reversing section.

According to the patent document, however, if the size of the paper being conveyed through the machine does not agree with the user-designated paper size, the following problems can occur during the printing. More specifically, since the recording paper that is waiting for the back side printing on the conveying path in the reversing section (that is, the recording paper that can be printed normally) is also ejected to the outside, reprinting must be made for all the number of papers being carried through the machine at the same time, thereby increasing a waste of the recording paper. As for the recording paper waiting for the back side printing on the conveying path in the reversing section, such control is also possible that ejects to the outside only the sheet on which the image formation is not made normally first, and then ejects, if the image formation is possible, the recording paper passing through the image formation. In this case, the sheet on which the image formation is made normally is laid on the sheet on which the image formation is not made normally in the paper output section. Thus, the user must search for the sheet on which the image formation is not made normally to remove it, which will result in an increase in the burden of the user.

SUMMARY OF THE INVENTION

The present invention is implemented to solve the foregoing problems. It is therefore an object of the present invention to provide an improved image forming apparatus and a control method of the image forming apparatus.

Another object of the present invention is to provide an image forming apparatus and control method capable of preventing the waste of the recording paper and facilitating handling of the recording paper after the image formation.

According to a first aspect of the present invention, that is an image forming apparatus comprising: an image forming section for carrying out image formation on recording paper;

a duplex conveying section for refeeding to said image forming section the recording paper having its first side undergo the image formation to perform image formation on a second side of the recording paper; an ejecting section to which the recording paper after the image formation is ejected; detecting means for detecting the size of the recording paper; and a control section for controlling, when performing image formation on both sides of a plurality of recording papers, a sequence of feeding the plurality of the recording papers to said image forming section, wherein said control section controls, when the size of the recording paper detected by said detecting means differs from a predetermined size, the recording paper, as to which a decision is made that its size differs, is refed to said image forming section through said duplex conveying section, and is ejected to said ejecting section without performing the image formation.

According to a second aspect of the present invention, that is a control method of an image forming apparatus for performing image formation on both sides of recording paper, said control method comprising: a detecting step of detecting a size of the recording paper being conveyed to undergo image formation on its first side; and an ejection control step of refeeding, when the size detected differs from a predetermined size, the recording paper, as to which a decision is made that its size differs, to an image forming section of image forming apparatus, and ejecting the recording paper to an ejecting section of said apparatus through said image forming section without performing the image formation.

According to the present invention, the image forming apparatus carries out the control in such a manner that when the image formation is not performed normally on the first side of the recording paper during the alternate duplex printing, the recording paper is conveyed to the reversing section. Thus the conveyance of the recording paper is continued as in the normal image formation, but the image formation onto the second side is not performed. In this way, the sequence of the recording paper ejected to the paper output section is the same as in the normal printing, but the image formation is not performed on the second side of the recording paper that does not undergo the normal image formation. As a result, a user can easily decide the paper on which the image formation is not performed normally. In addition, if it is found that a paper that likely causes a paper jam is being conveyed on the conveying path, ejecting the paper to the paper output section without adding any operation can prevent the paper jam. Thus, the subsequent recording papers being conveyed through the apparatus can undergo normal printing and ejection.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The invention will now be described with reference to the accompanying drawings.

Embodiment 1

Figure 1:
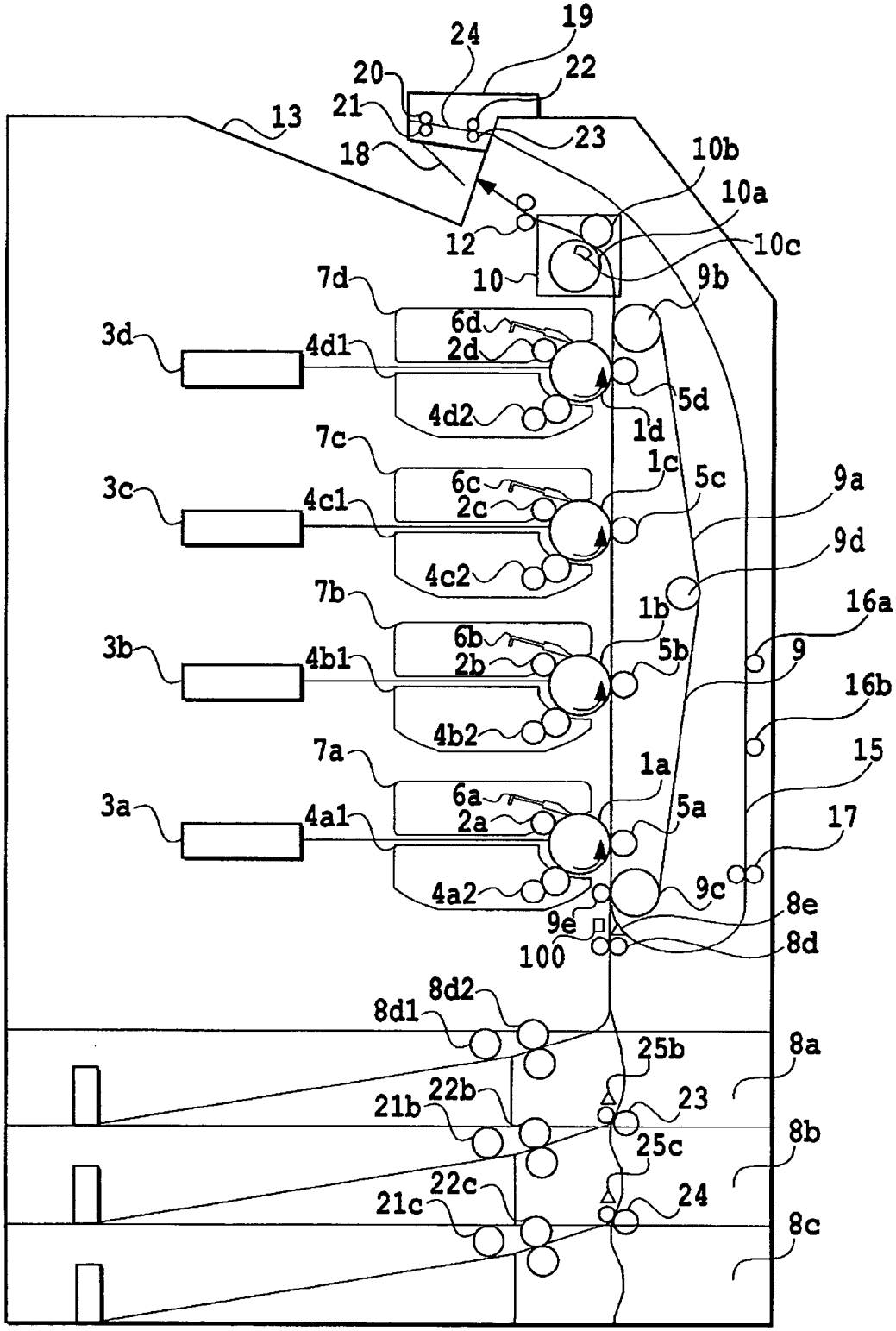
FIG. 1 is a schematic diagram of an image forming apparatus.

FIG. 1 is a diagram showing an overall configuration of an image forming apparatus of the present embodiment. The present embodiment employs as an image forming apparatus a color laser printer capable of forming multiple colors. First, the overall configuration of the image forming apparatus will be described, followed by the description of various portions.

(Overall Configuration)

The image forming apparatus as shown in FIG. 1 includes four photoconductive drums 1 (1*a*-1*d*) as image carriers. The photoconductive drums 1 each have the following components around them in the direction of rotation in the order described below, thereby constituting an image forming means. A charging means 2 (2*a*-2*d*) for uniformly charging the surface of the photoconductive drum 1. An exposure means 3 (3*a*-3*d*) for applying a laser beam in response to image information to generate an electrostatic latent image on the photoconductive drum 1. A developing means 4 (4*a*-4*d*) for depositing toner on the electrostatic latent image to develop a toner image. A transfer unit 5 (5*a*-5*d*) for transferring the toner image on the photoconductive drum 1 to a sheet (recording paper). A cleaning means 6 (6*a*-6*d*) for removing post-transfer toner remaining on the surface of the photoconductive drum 1 after the transfer.

Here, the photoconductive drum 1, charging means 2, developing means 4 and cleaning means 6 are integrated into a cartridge, thereby constituting a process cartridge 7 (7*a*-7*d*).

A sheet fed from a feed section 8 is conveyed to the image forming means by a conveying means 9 composed of a conveyer belt. Thus toner images of the individual colors are transferred sequentially to form a multicolored image on the sheet. Then, the sheet undergoes heating and fixing by a fixing means 10, and is output to an ejecting section 13 by pair of ejecting rollers 11 and 12 to be stacked up.

(Feed Section)

The feed section 8 is composed of a feed cassette 8*a* and a registration roller 8*d*. The feed cassette 8*a*, which contains a number of sheets, is loaded at the bottom inside the apparatus body. At the image formation, the sheets are separated and fed one by one from the feed cassette 8*a* by a cassette pickup roller 8*d*1, and are conveyed to the conveying means 9 by a cassette convey roller 8*d*2 and registration roller 8*d*.

The separation and conveyance of the sheets in the feed cassette 8*a* is carried out via a gear driving train powered by a feed motor in the feed section 8, which is not shown in FIG. 1.

At the downstream side of the registration roller 8*d*, between it and an absorbing roller 9*e* which will be described later (which corresponds to the position C of FIG. 3), a registration sensor 8*e* and a recording paper deciding sensor 100 are provided. The registration sensor 8*e* outputs (turns on) a detection signal when the sheet being conveyed from the feed section 8 to the image forming section reaches the registration sensor 8*e*, and turns off the detection signal when the sheet departs from the registration sensor 8*e*. The detection signal from the registration sensor 8*e* is delivered to a printer controller which will be described later. The printer controller calculates the conveyance direction length of the sheet being conveyed from the feed section 8 to the image forming section according to the detection signal fed from the registration sensor 8*e* and the conveying speed of the recording paper conveyed from the feed section 8 to the image forming section.

The recording paper deciding sensor 100 is composed of a light-emitting device and a light-receiving device for receiving the light from the light-emitting device, for example. The recording paper deciding sensor 100 operates as follows. When the sheet being conveyed from the feed section 8 to the image forming section reaches the position between the light-emitting device and light-receiving device, the light amount received by the light-receiving device decreases. According to the reduction rate of the received light amount, the recording paper deciding sensor 100 makes a decision as to the type of the sheet (for example, as to whether the recording paper is pervious such as transparent or semitransparent, or impervious), and delivers the decision signal to a printer controller which will be described later.

(Image Forming Section)

The photoconductive drums 1 serving as the image carriers are each constructed by applying an organic photoconductor layer (OPC) on the outer surface of an aluminum cylinder. The photoconductive drums 1, which are rotatably supported at their ends with flanges, are driven counterclockwise in FIG. 1 by transferring driving power to their one end from a driving motor not shown.

Each charging means 2, which is an electroconductive roller shaped in a cylinder, is provided for uniformly charging the surface of the photoconductive drum 1 by bringing it into contact with the surface of the photoconductive drum 1 and by applying a charging bias voltage thereto from a power supply not shown.

The exposure means 3 each have a polygon mirror which is irradiated with the image light that is supplied from a laser diode not shown and corresponds to the image signal.

The developing means 4 is composed of toner storages 4*a*1-4*d*1 which store black, cyan, magenta and yellow toners, respectively, and developing rollers 4*a*2-4*d*2. The developing rollers 4*a*2-4*d*2, which are adjacent to the photosensitive surfaces, are driven by a driver not shown, and carry out developing by a developing bias voltage applied from a developing bias power supply not shown.

Inside a transfer conveyer belt 9*a* which will be described later, there are provided transfer units 5*a*-5*d* which are brought into contact with the transfer conveyer belt 9*a* in such a manner that they face the four photoconductive drums 1*a*-1*d*. The transfer units 5*a*-5*d* are connected to a transfer bias power supply not shown. When the positive charges are applied to the sheet from the transfer units 5*a*-5*d* via the transfer conveyer belt 9*a*, these electric fields cause the individual negative color toner images on the photoconductive drums 1 to be sequentially transferred onto the sheet making contact with the photoconductive drums 1, thereby generating the multicolored image.

(Fixing Section)

The fixing means 10, which fixes the toner images by applying heat and pressure on the images generated on the sheet, includes a fixing belt 10*a* and elastic pressure roller 10*b*. The elastic pressure roller 10*b* put the fixing belt 10*a* therebetween, and constitute a fixing nip section N with a prescribed width having a predetermined pressure on a belt guide component 10*c*.

In the state in which the fixing nip section N is heated to a prescribed temperature and regulated at that temperature, the sheet on which the unfixed toner images are formed is conveyed from the image forming section, and is guided into the fixing nip section N. More specifically, the sheet is guided between the fixing belt 10*a* and elastic pressure roller 10*b* of the fixing nip section N with its image side facing upward, that is, facing to the surface of the fixing belt. Thus, the sheet, having its image side placed closely to the outer surface of the fixing belt 10*a* in the fixing nip section N, is squeezed and conveyed through the fixing nip section N together with the fixing belt 10*a*.

While the sheet is squeezed and conveyed through the fixing nip section N together with the fixing belt 10*a*, the sheet is heated by the fixing belt 10*a* so that the unfixed toner images on the sheet are heated and fixed.

(Details of Sheet Conveyance)

The sheet fed from the feed section 8 is conveyed to the image forming region by the conveying means 9. The transfer conveyer belt 9*a* serving as a recording medium carrier constituting the conveying means 9 is stretched over and supported by three rollers, a driving roller 9*b* and driven rollers 9*c* and 9*d*, and is disposed in such a manner as to face to all the photoconductive drums 1*a*-1*d*.

The transfer conveyer belt 9*a* is circulated by the driving roller 9*b* in such a manner that its outer surface, which faces the photoconductive drums 1, absorbs the sheet electrostatically to bring the sheet into contact with the photoconductive drums 1. In this way, the sheet is conveyed to the transfer position by the transfer conveyer belt 9*a* so as to transfer the toner images on the photoconductive drums 1 to the sheet.

In addition, at the most upstream position of the transfer conveyer belt 9*a*, an absorbing roller 9*e* is disposed for nipping the sheet with the belt 9*a* and for having the sheet absorbed to the belt 9*a*. During the conveyance of the sheet, a voltage is applied to the absorbing roller 9*e* to generate an electric field between the absorbing roller 9*e* and the driven roller 9*c* facing it. This causes dielectric polarization between the transfer conveyer belt 9*a* and the sheet, thereby producing the electrostatic absorbing force between them.

In the duplex printing, after the fixing means 10 fixes the images on the sheet, a flapper 18, which is placed immediately downstream from the pair of ejecting rollers 11 and 12, guides the sheet to the sheet reversing section 19 with a solenoid and the like not shown so that a pair of reversing rollers 20 and 21 convey the sheet.

A sensor not shown, which is disposed near the pair of reversing rollers 20 and 21, detects the rear edge of the sheet. When the rear edge of the sheet is conveyed downstream from the flapper 18 without fail, the flapper 18 is returned to its original position with the solenoid and the like to establish the conveying path 24 toward a pair of reconveying rollers 22 and 23.

After the flapper 18 establishes the conveying path 24 to the pair of the duplex conveying rollers 22 and 23, the pair of reversing rollers 20 and 21 having a driving source different from that of the image forming apparatus reverse their rotation, and convey the sheet to the pair of duplex conveying rollers 22 and 23. The sheet conveyed through a duplex conveying path 15 by the duplex conveying rollers 22 and 23 passes through obliquely conveying rollers 16*a* and 16*b* fixed to the front side of the image forming apparatus. The sheet is then conveyed to a U-turn roller 17 to be conveyed again to the image forming section by the U-turn roller 17 and the registration roller 8*d*.

The sheet reversing section 19 can be an external type (that is, an external sheet reversing unit) that is attachable to the image forming apparatus optionally.

(System Configuration of Image Forming Apparatus)

Figure 2:
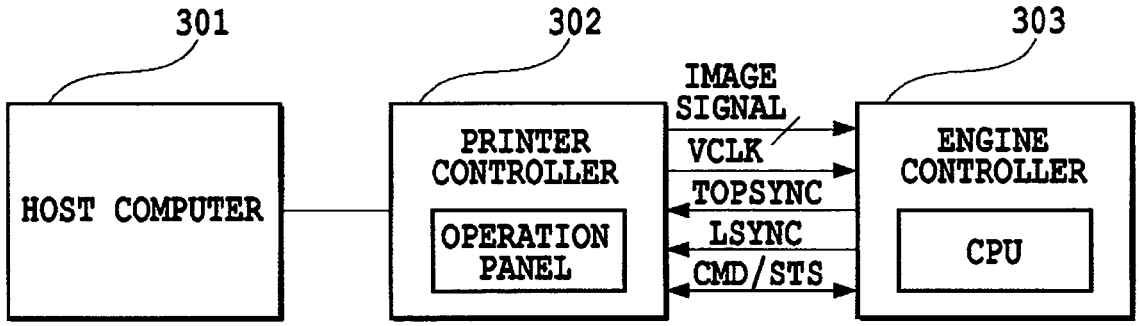
FIG. 2 is a system configuration diagram of an image forming apparatus.
Figure 6:
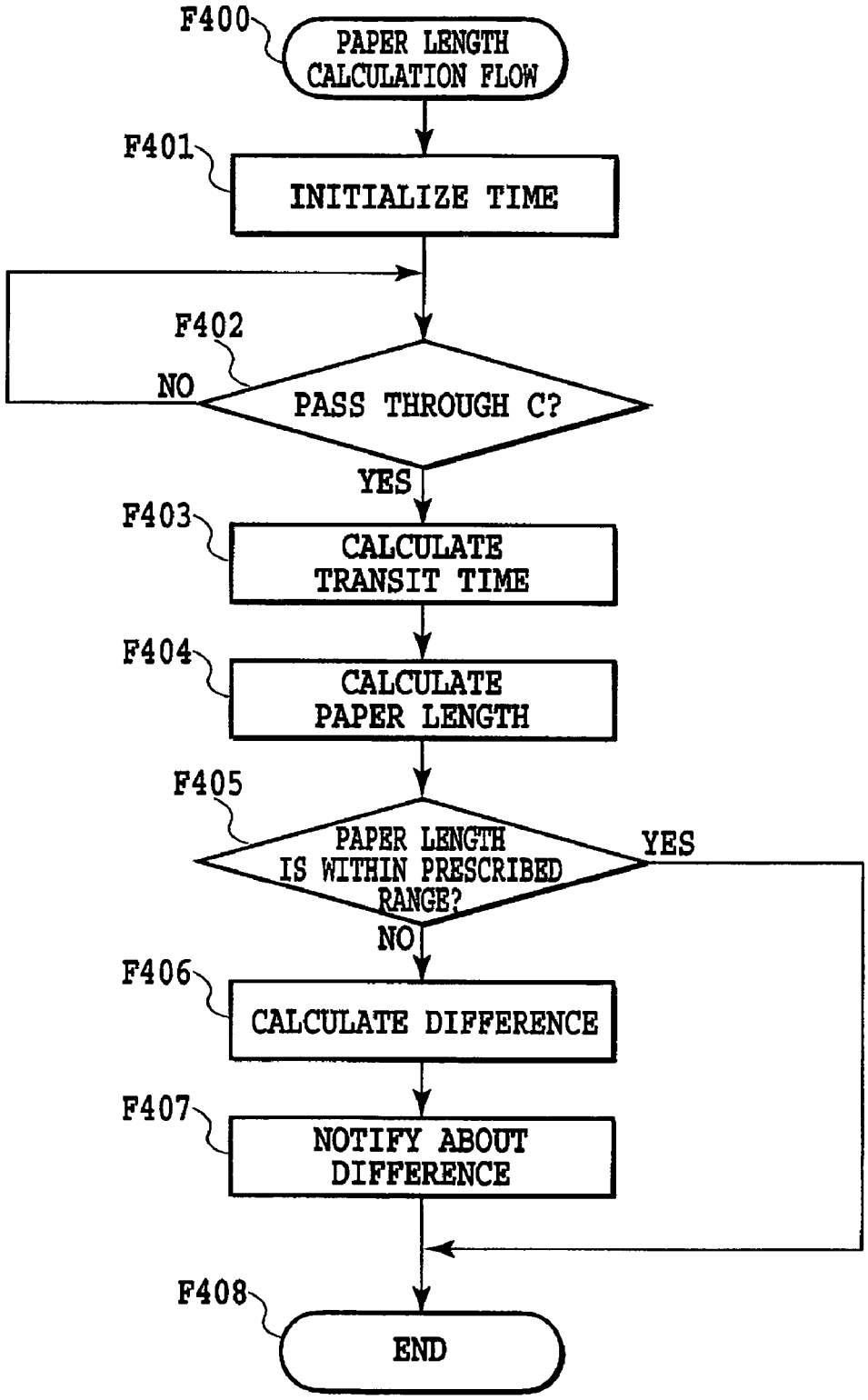
FIG. 6 is a flowchart illustrating paper length calculation.
Figure 7:
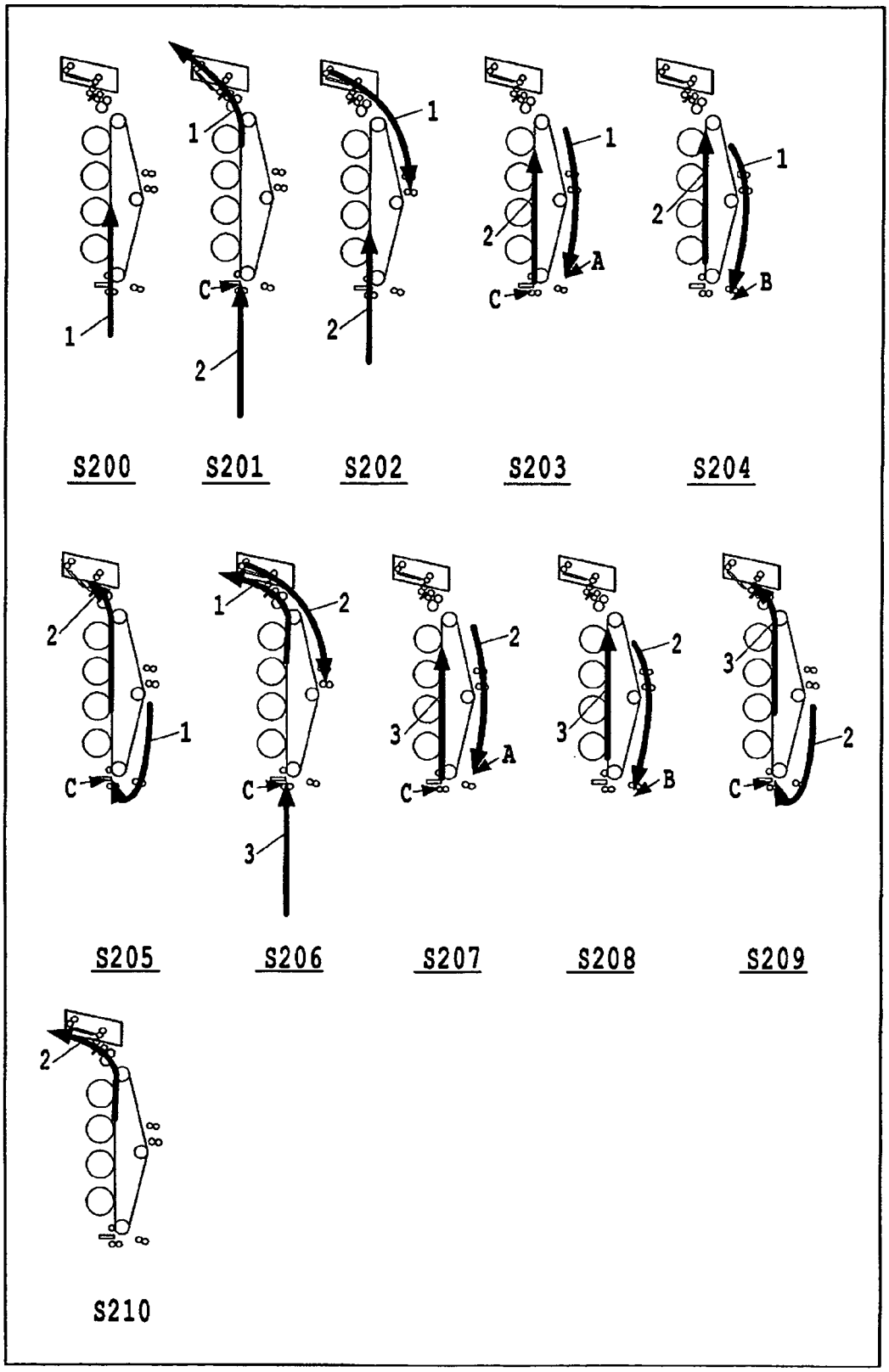
FIG. 7 is a diagram showing an alternate paper-feed duplex-print sequence (when paper type differs)

As shown in FIG. 2, the image forming apparatus includes a printer controller 302 and an engine controller 303 for chiefly carrying out mechanical control. The printer controller 302 receives and develops image information of a prescribed descriptive language, which is sent from the host computer 301, and outputs it as the black, cyan, magenta and yellow image signals. The printer controller 302, which controls the operation of the image forming apparatus in its entirety, includes a CPU for carrying out its operation control, a ROM that stores control procedures of the CPU including the control procedures of the operations as shown in FIGS. 3, 6 and 7 which will be described later, and a RAM that offers a working area of the CPU.

The printer controller 302 and engine controller 303 exchange a variety of control signals besides the image signals in a serial communication mode. These signals include a vertical synchronizing signal (TOPSYNC), a synchronizing signal in the vertical scanning direction of a page, and a horizontal synchronizing signal (LSYNC), a synchronizing signal in the horizontal scanning direction, which are fed from the engine controller 303 to the printer controller 302. The printer controller 302 applies a masking (under color removal) processing known to the public to input R, G and B image signals, and converts them to black, cyan, magenta and yellow image signals. The signals passing through the conversion are input to a FiFo (Fast In, Fast Out) memory, and are sequentially supplied to the engine controller 303 in synchronization with an image data transfer clock (VCLK). Thus the FiFo carries out the time axis conversion between the printer controller 302 and the engine controller 303.

(When Image Formation Fault Occurs Because of Disagreement of Paper Length)

Figure 3:
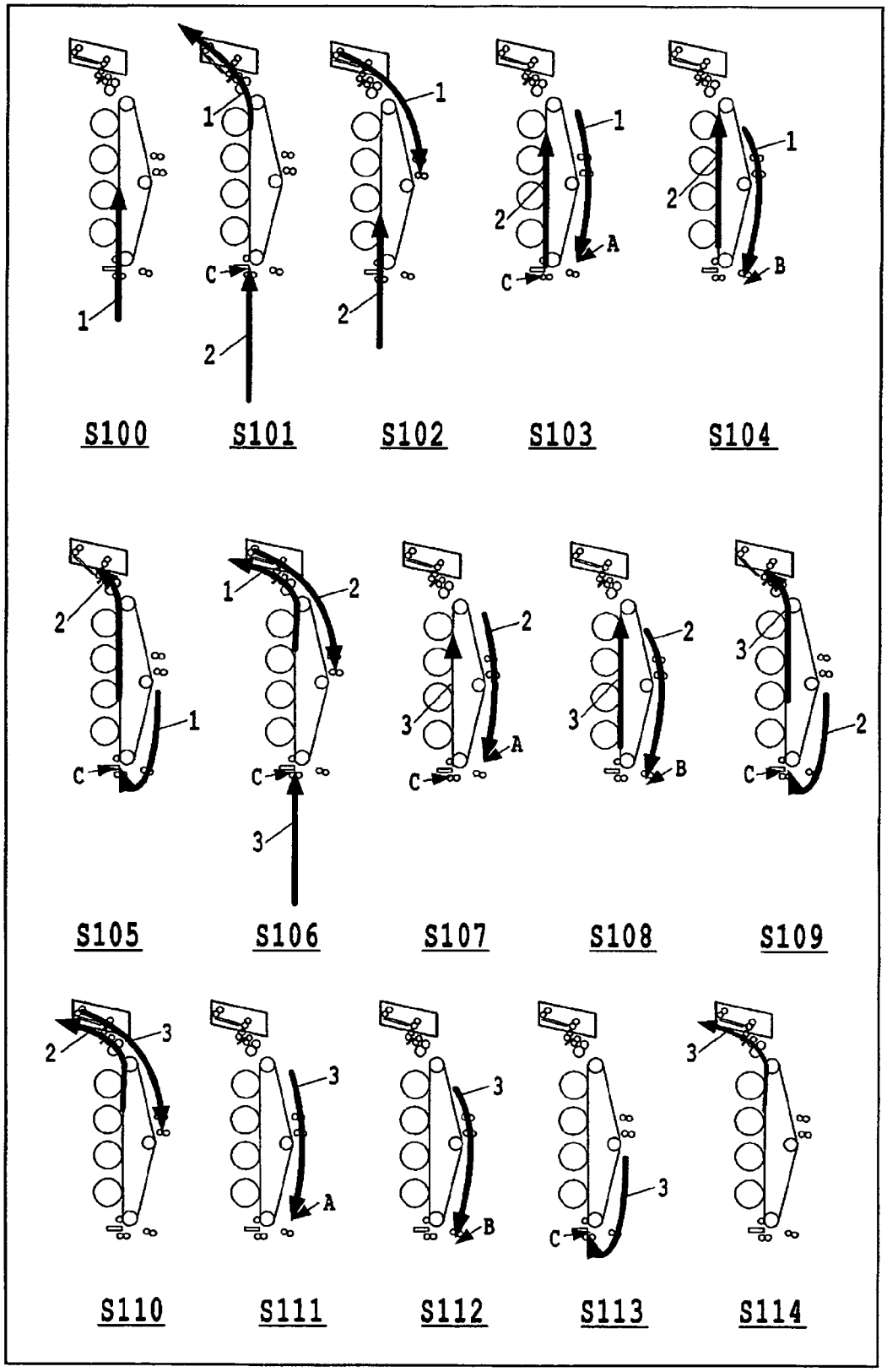
FIG. 3 is a diagram showing an alternate paper-feed duplex-print sequence (when paper length differs)
Figure 4:
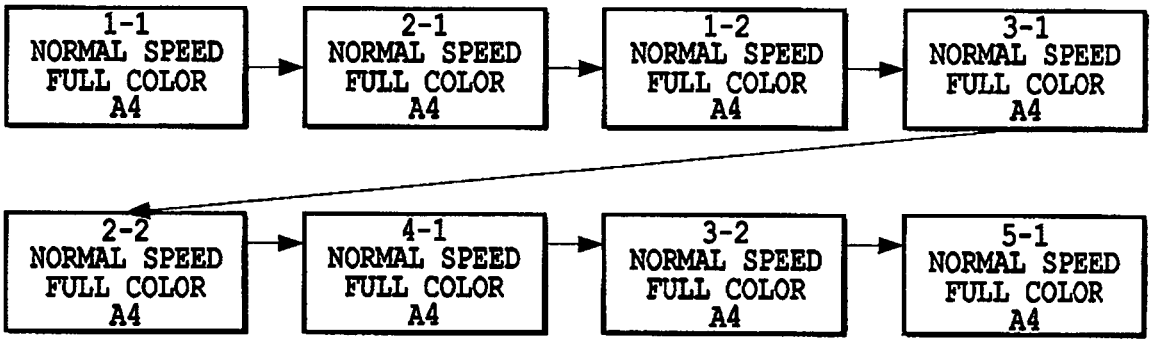
FIG. 4 is a diagram showing a printed side (front side or back side) and a print sequence during the alternate paper feed.
Figure 5:
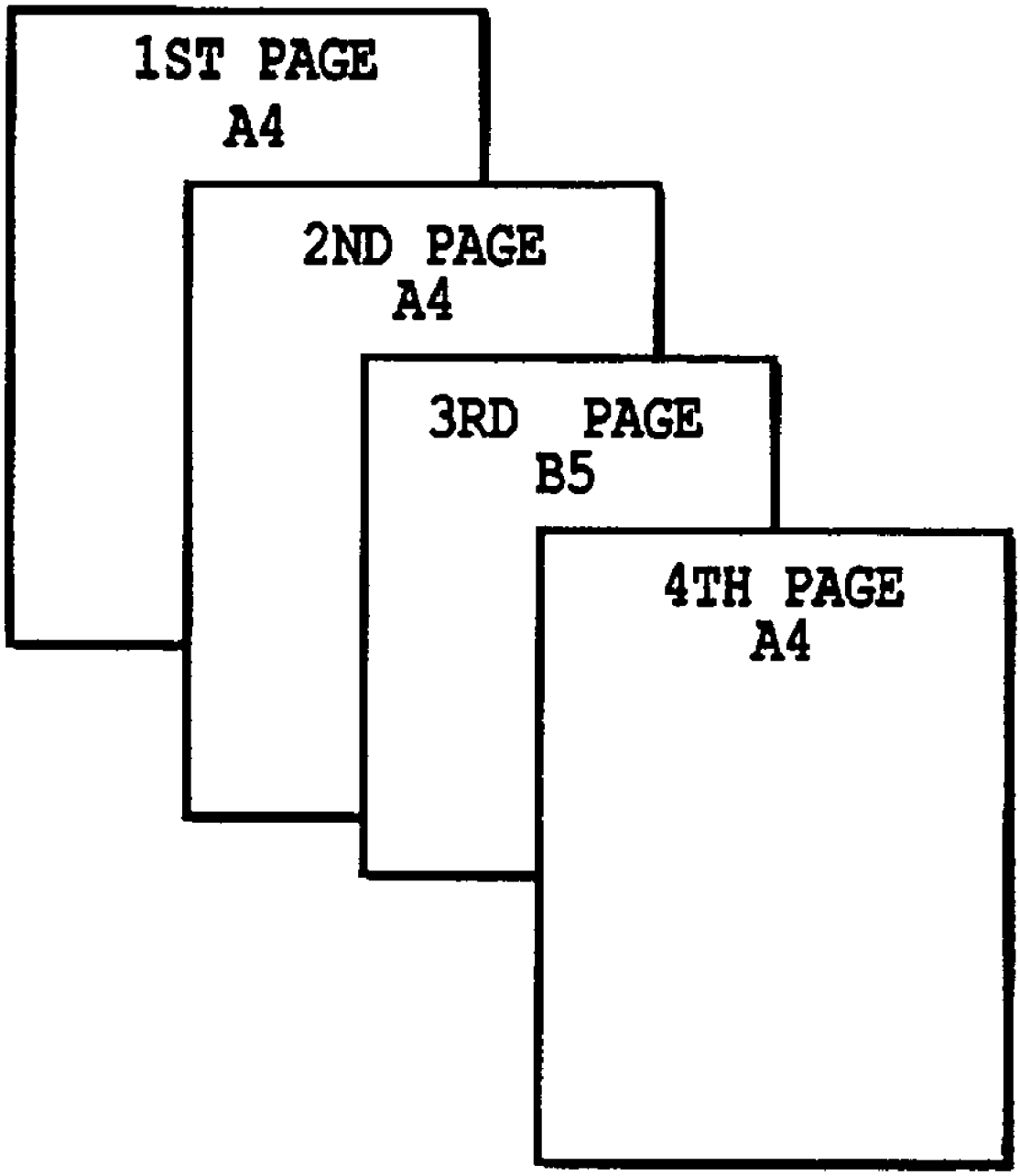
FIG. 5 is a diagram showing an example of the paper supplied from a paper feeder (when the paper length differs)

FIG. 3 illustrates a paper conveyance sequence in a case where an image formation fault occurs because of the paper length disagreement of a third recording paper during alternate duplex printing. FIG. 3 illustrates relationships between an outline of the configuration of FIG. 2 and sheets (which are shown in bold arrows: FIG. 7 which will be described later is the same). It is assumed here as shown in FIG. 4 that the print signal from the printer controller 302 instructs the paper size A4 without exception, and that the print command is given in the following sequence: a first sheet-front (1-1); a second sheet-front (2-1); the first sheet-back (1-2); a third sheet-front (3-1); the second sheet-back (2-2); a fourth sheet-front (4-1); the third sheet-back (3-2), etc. In addition, it is assumed that papers fed are A4, A4, B5 and A4 papers as shown in FIG. 5.

As illustrated in FIG. 3, sheets are separated and fed from the feed cassette 8*a* by the cassette pickup roller 8*d*1 one by one (numbers in FIG. 3 indicate the order of the sheets). Then, the first sheet is conveyed to the conveying means 9 by the cassette conveying roller 8*d*2 and registration roller 8*d* so that the image formation is performed on the front side (first side) of the sheet by the image forming section (S100).

The front side of the first sheet is subjected to the image formation by the image forming section, followed by fixing by the fixing means 10. Subsequently, the flapper 18, which is located immediately downstream of the pair of ejecting rollers 11 and 12, guides the first sheet to the sheet reversing section 19 with a solenoid and the like not shown to be conveyed to the pair of reversing rollers 20 and 21. At the timing that the rear edge of the front side of the first sheet does not lay on the forward edge of the front side of the second sheet, and that the rear edge of the front side of the second sheet passes by the point C when the back side of the first sheet is refed, the feed cassette 8*a* starts feeding the second sheet (S101).

The flapper 18 is returned to its original position by the solenoid and the like when the rear edge of the first sheet is conveyed downstream of the flapper 18 without fail with detecting the rear edge of the sheet with the sensor and the like not shown which are disposed near the pair of reversing rollers 20 and 21. Then, after establishing the conveying path 24 to the pair of reconveying rollers 22 and 23, the pair of reversing rollers 20 and 21, which have a driving source other than that of the image forming apparatus, rotate reversely to convey the sheet to the pair of duplex conveying rollers 22 and 23 (S102).

In this case, the conveying speed of the sheet which is given by the pair of reversing rollers 20 and 21, pair of duplex conveying rollers 22 and 23, obliquely conveying rollers 16, and U-turn roller 17, can be changed by varying the distance between the sheets or the duplex conveying distance. This is because the driving source installed in the sheet reversing unit can carry out driving control independently of the image forming apparatus. In the configuration of FIG. 2, the pair of reversing rollers 20 and 21 increase the speed at the reversal. Subsequently, the first sheet undergoes speed reduction at the refeed standby position A before the U-turn roller 17 so as to control the conveying speed from the sheet reversing unit to become equal to the conveying speed of the image forming apparatus (S103). In this case, the sheet conveyance is stopped unless the print signal of the back side is sent from the printer controller 302 by the timing at the refeed standby position A, or if the paper spacing between the rear edge of the second sheet and the forward edge of the first sheet becomes shorter than a prescribed spacing when the first sheet is refed without stopping the conveyance.

The first sheet refed from the refeed standby position A at the conveying speed of the image forming apparatus itself is conveyed to the sheet reversing section driving stop position B so that the driving of the sheet reversing section is stopped, and the sheet conveyance is carried out by only the drive of the feed section 8 after the sheet reversing section driving stop position B (S104 and S105). In this case, the obliquely conveying rollers 16*a* and 16*b* in the sheet reversing section 19 have such a structure as they can continue to convey the sheet by the drive of the paper feeder 8 of the image forming apparatus itself even when the driving of the sheet reversing section 19 is stopped by a one-way clutch.

The first sheet passing through the image formation on the front side and back side is ejected to the outside of the apparatus, and the second sheet is conveyed to the pair of duplex conveying rollers 22 and 23 by the sheet reversing section. At the timing that the rear edge of the back side of the first sheet does not lay on the forward edge of the front side of the third sheet, the third sheet is fed from the feed cassette 8*a* to start printing (S106).

Unless the image formation fault does not occur, the paper conveyance from S103 to S106 of FIG. 3 is repeated to continue printing. However, the present embodiment assumes that the paper length disagreement occurs at the third sheet. The print operation will be described below when the paper length disagreement occurs.

When the forward edge of the third sheet arrives at the registration sensor 8*e* at the C position, the printer controller 302 carries out the paper length calculation flow as shown in FIG. 6 in response to the detection signal from the registration sensor 8*e*. The paper length calculation flow is performed for all the recording papers conveyed from the feed section 8 to the image forming section. First, the value of the timer (not shown) in the engine controller is initialized by the time initializing operation: the value of the transit time through the registration sensor 8*e* at the position C, which has been counted before (F401), is initialized, and then the timer is started. The timer continues counting until the rear edge of the third sheet passes through the registration sensor 8*e* at the C position (F402).

Subsequently, the back side of the second sheet undergoes the speed reduction at the refeed standby position A to carry out the control of making the conveying speed from the sheet reversing unit equal to the conveying speed of the image forming apparatus (S107). At this point of time, the rear edge of the third sheet passes through the registration sensor 8*e* at the C position. Thus, the paper length calculation flow can calculate the paper length from the time required for the sheet to pass through the registration sensor 8*e* at the C position (the time counted by the timer) and the current conveying speed (F403 and F404). Then, the printer controller makes a decision as to whether the calculation result and the sheet length designated in FIG. 4 are within a specified range (F405). If a decision is made that they are within the range, the flow is closed (F408). In contrast, if a decision is made that they are not within the range, the printer controller calculates the difference between the two, notifies the CPU of the engine controller of the difference information (F406 and F407), and terminates the flow (F408).

As for the back side of the second sheet refed from the refeed standby position A at the conveying speed of the image forming apparatus itself, it is conveyed to the sheet reversing section driving stop position B, in response to which the driving of the sheet reversing section is stopped, and the sheet is conveyed by only the driving of the feed section 8 after the position B (S108 and S109).

The second sheet having its front side and back side undergo the image formation is ejected to the outside of the apparatus. The third sheet with which the paper length disagreement occurs is conveyed to the pair of duplex conveying rollers 22 and 23 by the sheet reversing section (S110). Since the engine controller has received the difference information by this point of time, it adjusts the timing up to the time at which the pair of reversing rollers 20 and 21 of the sheet reversing section starts reversing the rotation in response to the difference information, thereby conveying the sheet to the refeed standby position A without fail. Thus, the engine controller controls the third sheet in such a manner that it reduces the speed at the refeed standby position A to make the conveying speed from the sheet reversing unit equal to the conveying speed of the image forming apparatus (S111). The third sheet, which is refed from the refeed standby position A at the conveying speed of the image forming apparatus itself, is conveyed to the sheet reversing section driving stop position B at which the driving of the sheet reversing section is stopped. Thus, after the position B, the sheet is conveyed only by the driving of the feed section 8 (S112 and 113).

The third sheet is ejected following the second sheet to the outside of the apparatus without undergoing the image formation of the back side of the third sheet (S114). In this way, it is possible for the control to continue the conveyance of the recording paper as in the normal image formation and to prevent the image formation onto the back side of the third sheet. This makes it possible to eject the recording paper to the paper output section in the same sequence as in the normal printing. In addition, since the recording paper, on which the image formation has not been made normally, does not undergo the image formation on its back side, the user can readily decide the paper on which the image formation is not made normally.

Although the present embodiment is described in detail by way of example of the third sheet, it also makes a decision as to the first sheet and second sheet whether their length agrees with the designated sheet length by calculating the paper length in the same way.

In addition, in the present embodiment, the disagreement of the sheet length which is the conveyance direction length of the sheet is detected to carry out the control as described above. However, the disagreement of a length (width) in a direction orthogonal to the sheet conveyance direction may be detected to carry out the control in the same manner. More specifically, the disagreement of the vertical or horizontal size of the sheet may be detected to carry out the above control.

Embodiment 2

As the first embodiment, the second embodiment is also applied to the image forming apparatus with the configuration as shown in FIGS. 1 and 2. Accordingly, the description about the contents already described in the explanation of the first embodiment will be omitted in the second embodiment, and the same components in the diagrams are designated by the same reference numerals.

(When Image Formation Fault Occurs Because of Disagreement of Paper Type)

FIG. 7 illustrates a paper conveyance sequence in a case where an image formation fault occurs because of the paper type disagreement of the paper during alternate duplex printing. Numbers in FIG. 7 indicate the order of the sheets.

Figure 8:
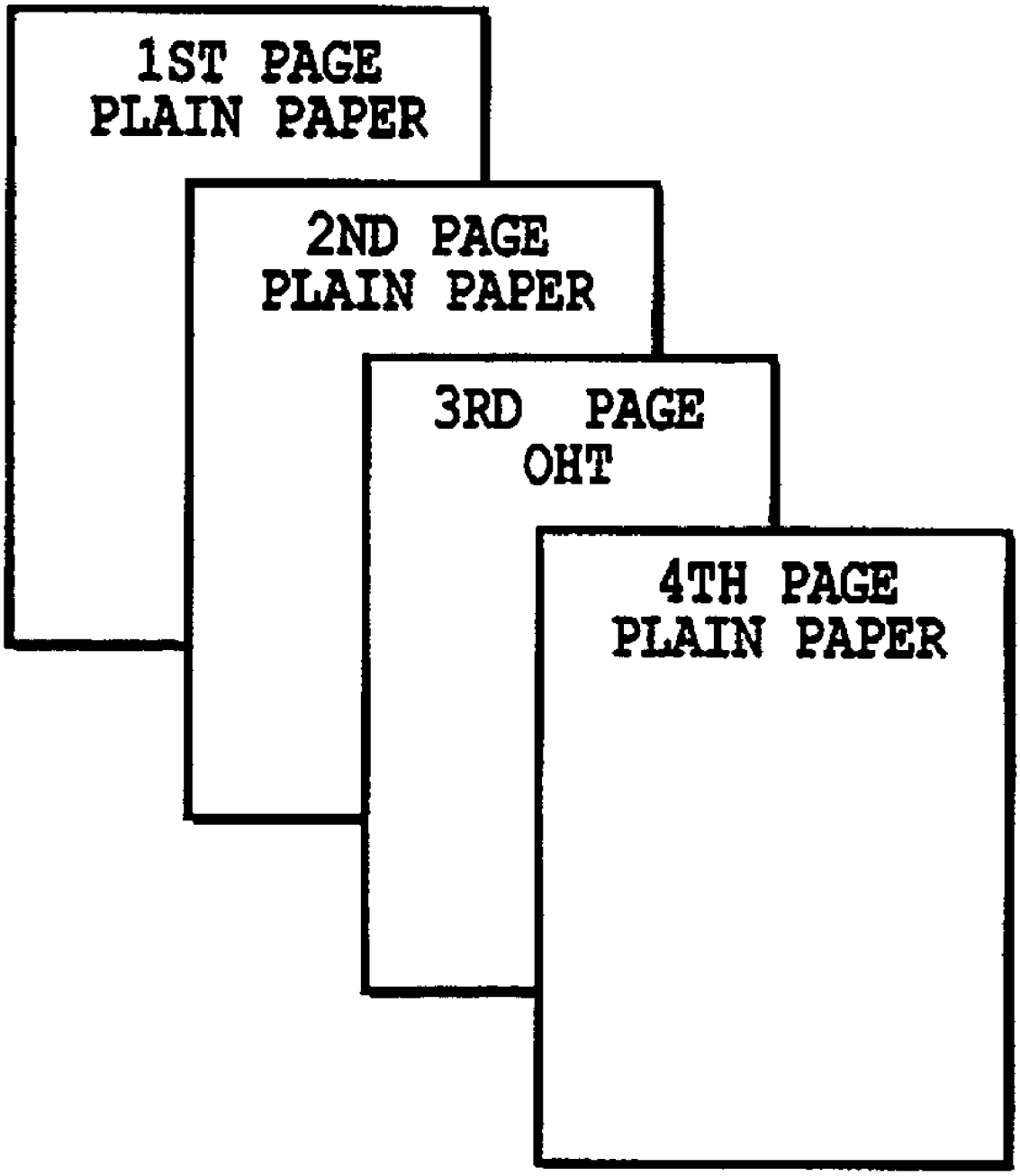
FIG. 8 is a diagram showing another example of the paper supplied from the paper feeder (when the paper type differs).

In the present embodiment, it is assumed that the print signal fed from the printer controller 302 is the same as that of the embodiment 1 which is shown in FIG. 4, and that as for the papers fed, two plain papers are fed continuously, followed by a third paper, a transparent paper, which is not subjected to the duplex printing normally, as illustrated in FIG. 8.

A first sheet is separated and fed from the feed cassette 8*a* by the cassette pickup roller 8*d*1, and is conveyed to the conveying means 9 by the cassette conveying roller 8*d*2 and registration roller 8*d* (S200).

The front side of the first sheet undergo the image fixing by the fixing means 10. Subsequently, the flapper 18, which is located immediately downstream of the pair of ejecting rollers 11 and 12, guides the first sheet to the sheet reversing section 19 with a solenoid and the like not shown to be conveyed to the pair of reversing rollers 20 and 21. At the timing that the rear edge of the front side of the first sheet does not lay on the forward edge of the front side of the second sheet, and that the rear edge of the front side of the second sheet passes through the point C when the back side of the first sheet is refed, the feed cassette 8*a* starts feeding the second sheet (S201).

The flapper 18 is returned to its original position by the solenoid and the like when the rear edge of the first sheet is conveyed downstream of the flapper 18 without fail with detecting the rear edge of the sheet with the sensor and the like not shown which are disposed near the pair of reversing rollers 20 and 21. Then, after establishing the conveying path 24 to the pair of reconveying rollers 22 and 23, the pair of reversing rollers 20 and 21, which have a driving source other than that of the image forming apparatus, rotate reversely to convey the sheet to the pair of duplex conveying rollers 22 and 23 (S202).

In this case, the conveying speed of the first sheet, which is given by the pair of reversing rollers 20 and 21, pair of duplex conveying rollers 22 and 23, obliquely conveying roller 16, and U-turn roller 17, can be changed according to the distance between the sheets or the duplex conveying distance. This is because the driving source installed in the sheet reversing unit can carry out driving control independently of the image forming apparatus. In the configuration of FIG. 2, the pair of reversing rollers 20 and 21 increase the speed at the reversal. Subsequently, the first sheet undergoes speed reduction at the refeed standby position A before the U-turn roller 17 so as to control the conveying speed from the sheet reversing unit to become equal to the conveying speed of the image forming apparatus (S203). In this case, the sheet conveyance of the first sheet is stopped unless the print signal of the back side is sent from the printer controller 302 by the timing at the refeed standby position A, or if the paper spacing between the rear edge of the second sheet and the forward edge of the first sheet becomes shorter than a prescribed spacing when the first sheet is refed without stopping the conveyance.

The first sheet refed from the refeed standby position A at the conveying speed of the image forming apparatus itself is conveyed to the sheet reversing section driving stop position B so that the driving of the sheet reversing section is stopped, and the sheet conveyance is carried out by only the drive of the feed section 8 after the sheet reversing section driving stop position B (S204 and S205). In this case, the obliquely conveying rollers 16*a* and 16*b* in the sheet reversing section 19 have such a structure as they can continue to convey the sheet by the drive of the paper feeder 8 of the image forming apparatus itself even when the driving of the sheet reversing section 19 is stopped by a one-way clutch.

The first sheet passing through the image formation on the front side and back side is ejected to the outside of the apparatus, and the second sheet is conveyed to the pair of duplex conveying rollers 22 and 23 by the sheet reversing section. At the timing that the rear edge of the back side of the first sheet does not lay on the forward edge of the front side of the third sheet, the third sheet is fed from the feed cassette 8*a* to start printing (S206).

The back side of the second sheet undergoes the speed reduction at the refeed standby position A to carry out the control of making the conveying speed from the sheet reversing unit equal to the conveying speed of the image forming apparatus (S207).

Unless the image formation fault does not occur, the paper conveyance flow from S203 to S206 of FIG. 7 is repeated to continue printing. However, the present embodiment assumes that the paper type disagreement occurs at the third sheet. The print operation will be described below when the paper type disagreement occurs.

The recording paper deciding sensor 100 detects the types of all the recording paper passing through it. When the forward edge of the third sheet arrives at the C position and the recording paper deciding sensor 100 detects that the sheet passing through the C position is a transparent sheet (such as an OHT sheet) that does not normally undergo duplex image formation, the following steps are taken. Specifically, the recording paper deciding sensor 100 notifies the CPU in the engine controller that it is an OHT sheet. Conveying the OHT sheet to the reversing section can cause a paper jam because the sheet is strong, which can bring about convey fault in the reversing section. Accordingly, the front side of the third sheet, which undergoes the image formation by the image forming section, is ejected to the paper output section without being supplied to the reversing section. Then the back side of the second sheet, which is refed from the refeed standby position A at the conveying speed of the image forming apparatus itself, is conveyed to the sheet reversing section driving stop position B. Thus the driving of the sheet reversing section is stopped, and the sheet is conveyed by only the driving of the feed section 8 after the position B (S208 and S209). The second sheet having its front side and back side undergo the image formation is ejected to the outside of the apparatus, and the print operation is closed (S210).

Incidentally, the control of the present embodiment can be performed before carrying out the control based on the disagreement of the paper length as described in the embodiment 1. In this case, since a sheet such as an OHT sheet can be ejected before being conveyed to the reversing section, the probability of causing a paper jam can be further reduced.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2005-112469 filed Apr. 8, 2005, which is hereby incorporated by reference herein.

What is claimed is:

1. An image forming apparatus comprising:

an image forming section for carrying out image formation on recording paper;

a duplex conveying section for refeeding to said image forming section the recording paper having its first side undergo the image formation to perform image formation on a second side of the recording paper;

an ejecting section to which the recording paper after the image formation is ejected;

a detecting section for detecting the size of the recording paper; and a control section for controlling image formation, when performing image formation on both sides of a plurality of recording papers, so as to undergo the image formation on the first side of a second recording paper fed after a first recording paper prior to the image formation on the second side of the first recording paper by the image forming section, wherein the control section controls, when an error occurs indicating the length of the second recording paper is different from a predetermined length, so as to reverse the second recording paper through the duplex conveying section irrespective of the length of the second recording paper to perform image formation on the second side of the first recording paper by the image forming section, and to eject the second recording paper from the ejecting section after the first recording paper without performing the image formation.

2. The image forming apparatus as claimed in claim 1, wherein said detecting section comprises:

a recording paper detection sensor for detecting the recording paper to be fed to said image forming section at an upstream side of said image forming section; and calculation means for obtaining the size of the recording paper from detection time of the recording paper by the recording paper detection sensor and conveying speed of the recording paper.

3. The image forming apparatus as claimed in claim 1, further comprising a reversing section that comprises a reversing roller for reversing the recording paper fed from said image forming section, wherein said control section controls reversing timing of the recording paper by said reversing roller in response to difference information between the length of the recording paper, as to which a decision is made that its length differs, and the predetermined length.

4. The image forming apparatus as claimed in claim 1, further comprising recording paper deciding means for deciding a type of the recording paper, wherein said control section ejects the recording paper to said ejecting section without feeding to said reversing section when the type of the recording paper said recording paper deciding means decides does not agree with a predetermined type.

5. The image forming apparatus as claimed in claim 4, wherein said recording paper deciding means includes a deciding sensor for deciding the type of the recording paper at an upstream side of said image forming section.

* * * * *